US010443263B2

(12) United States Patent
LaHood

(10) Patent No.: US 10,443,263 B2
(45) Date of Patent: Oct. 15, 2019

(54) REMOVABLE INSULATED FLOOR FOR A PORTABLE SHELTER

(71) Applicant: CLAM CORPORATION, Rogers, MN (US)

(72) Inventor: John Matthew LaHood, Waconia, MN (US)

(73) Assignee: Clam Corporation, Rogers, MN (US)

( * ) Notice: Subject to any disclaimer, the term of this patent is extended or adjusted under 35 U.S.C. 154(b) by 0 days.

(21) Appl. No.: 15/861,402

(22) Filed: Jan. 3, 2018

(65) Prior Publication Data

US 2019/0203500 A1 Jul. 4, 2019

(51) Int. Cl.

| | |
|---|---|
| ***E04H 15/56*** | (2006.01) |
| ***E04H 15/48*** | (2006.01) |
| ***E04H 15/64*** | (2006.01) |
| *E04H 15/00* | (2006.01) |
| *E04H 15/20* | (2006.01) |

(52) U.S. Cl.

CPC ..... *E04H 15/56* (2013.01); *E04H 15/48* (2013.01); *E04H 15/64* (2013.01); *E04H 15/001* (2013.01); *E04H 2015/207* (2013.01)

(58) Field of Classification Search

CPC ..... E04H 15/48; E04H 15/56; E04H 15/44; E04H 15/32; E04H 15/64; E04H 15/001; E04H 15/207; E04H 15/36; B32B 37/12; B32B 37/14

USPC ..... 135/135, 137, 147–148, 151, 152, 116, 135/115, 119, 901, 905

See application file for complete search history.

(56) References Cited

U.S. PATENT DOCUMENTS

| | | | | |
|---|---|---|---|---|
| 1,728,356 A * | 9/1929 | Morgan | E04H 15/50 | 135/154 |
| 4,239,247 A | 12/1980 | Hinz | | |
| 4,305,414 A * | 12/1981 | Bareis | E04H 15/56 | 135/116 |
| 5,622,198 A | 4/1997 | Elsinger | | |
| 5,749,387 A | 5/1998 | Thompson | | |
| 6,167,898 B1 * | 1/2001 | Larga | E04H 15/20 | 135/124 |

(Continued)

OTHER PUBLICATIONS

Web page from Dick's Sporting Goods showing a Clam Jason Mitchell 5000 Thermal 6-Person Ice Fishing Shelter (date unknown but prior to U.S. Appl. No. 15/681,402).

(Continued)

*Primary Examiner* — Winnie Yip
(74) *Attorney, Agent, or Firm* — Cook Alex Ltd.

(57) ABSTRACT

A removable insulated floor for use with a portable shelter, the floor including a central section defining a ground engaging area and having at least three layers, at least one side wall extending upward from and being connected to the central section at an edge of the ground engaging area and having an outward facing side wall fastener, the central section includes at least one opening, and a central section fastener is connected to an upper layer of the central section and is located proximate the at least one opening, and at least one patch having a patch fastener connected to a lower surface of the patch and being releasably connected to the central section fastener located proximate the at least one opening. The floor is usable in combination with a portable shelter having complementary fasteners for releasable connection of the floor to the shelter.

20 Claims, 5 Drawing Sheets

(56) References Cited

U.S. PATENT DOCUMENTS

| | | | | |
|---|---|---|---|---|
| 6,948,280 | B2 | 9/2005 | Marcinkowski et al. | |
| 7,320,332 | B2 * | 1/2008 | Reis | E04H 15/44 135/115 |
| 7,665,478 | B2 * | 2/2010 | Wehner | A01G 9/16 135/126 |
| 8,161,992 | B2 * | 4/2012 | Cantwell | E04H 15/54 135/116 |
| 8,915,258 | B1 * | 12/2014 | Beam | E04H 15/001 135/117 |
| 9,416,527 | B2 | 8/2016 | McInerney | |
| 9,512,632 | B2 | 12/2016 | Cook | |
| 9,771,729 | B2 * | 9/2017 | Workman | E04H 15/44 |
| 9,777,507 | B2 | 10/2017 | Walter | |
| 9,951,536 | B2 * | 4/2018 | Bree | A01K 1/0035 |
| 2003/0106578 | A1 * | 6/2003 | Cornist | E04H 15/324 135/137 |
| 2006/0021643 | A1 | 2/2006 | Brensinger | |
| 2006/0048459 | A1 | 3/2006 | Moore | |
| 2006/0169729 | A1 | 8/2006 | Reis | |
| 2006/0243312 | A1 * | 11/2006 | Williamson | E04H 15/44 135/121 |
| 2010/0307550 | A1 | 12/2010 | Silverberg et al. | |
| 2012/0211042 | A1 | 8/2012 | Richter | |
| 2017/0167158 | A1 * | 6/2017 | Lynch | E04H 15/40 |

OTHER PUBLICATIONS

Web page from Dick's Sporting Goods showing a Clam Outdoors Quick-Set Pavilion Screen House (date unknown but prior to U.S. Appl. No. 15/681,402).

Web page from polarbird.com showing a 4T Insulated Floor for an Ice Shelter, and related photographs (date unknown but prior to U.S. Appl. No. 15/681,402).

* cited by examiner

REMOVABLE INSULATED FLOOR FOR A PORTABLE SHELTER

BACKGROUND OF THE INVENTION

Field of the Invention

The present invention generally relates to portable shelters, and more particularly to a removable insulated floor for a portable shelter.

Discussion of the Prior Art

Portable shelters, such as may be used for ice fishing, are known and typically include a lightweight flexible enclosure supported by a collapsible frame. While many constructions exist, the flexible enclosure often has multiple side walls, with each side wall connected to adjacent side walls and to a top wall. When a collapsible frame of the shelter is erected, the enclosure is free standing. Such portable shelters generally are sized to accommodate one or two individuals and their gear, but they certainly may provide a larger configuration.

The side walls and top wall may be constructed using various sheet materials when forming broad panels, including fabrics, such as canvas, polyester or nylon, and may include areas having screen or transparent sheet material for windows. Harsh weather conditions to which a shelter may be subjected can present challenges to the durability of a shelter and to the safety and comfort of its users. The shelters may be subjected to very cold temperatures, rain or water, snow, sun, high winds, and in some instances may be subjected to extreme heat or even be located in the close vicinity of a source of heat or fire. Such conditions have led to the development of composite panels for the side walls and/or top wall, and the composite panels generally also will be referred to herein as being "fabrics."

To meet these challenging conditions, more modern fabrics for panels used as side walls and top walls have been constructed to be flame resistant and/or to include some form of insulation, so as to improve the safety and comfort available to shelter users. Such fabrics may be composites having multiple layers. However, retention of heat within a shelter can result in melting of the ice bounded by the shelter side walls, leaving undesirable standing water within the shelter's occupied space. To combat this, floors and even insulated floors have been introduced, yet they tend to have disadvantages. For instance, it can be difficult to try to install a floor, and with foot traffic, it also can be difficult for the floor to maintain its position relative to the shelter. In addition, it would be desirable to avoid water and wind intrusion along the floor. Moreover, if used for ice fishing, the floor must provide the opportunity to fish through holes that have been drilled in the ice. Floors that have openings that permanently expose the ice tend to promote melting and standing water. Problems also can arise with floors designed to have users cut holes through layers of material, such as to provide access to a hole in the ice. Having users cut holes through layered material can be problematic because the edges of the floor at the location of the holes must be completely sealed or they risk troublesome water intrusion between the layers and a partial loss of the insulation property of the floor.

SUMMARY OF THE INVENTION

The purpose and advantages of the invention will be set forth in and apparent from the description and drawings that follow; as well as will be learned by practice of the claimed subject matter.

This disclosure generally provides removable insulated floors for portable shelters, which provide a unique structure resulting in desirable advantages. The insulated floor of the present disclosure features a construction that includes multiple layers, which collectively provide water resistance and insulation properties. The construction includes pre-cut holes having overlying patches, thereby avoiding permanently exposed openings, as well as the need for a user to cut and reseal edges of a hole in the floor. The floor also includes first and second stage fasteners for more convenient installation, while providing secure connection of the floor to the shelter. These features provide a relatively compact, lightweight, easy to install insulated floor that tends to stay in place, offers optional openings through which to fish, resists melting of the ice below the floor and resists water intrusion both between layers and on top of the layered floor.

In a first aspect, this disclosure provides a removable insulated floor for use with a portable shelter, with the floor including a central section defining a ground engaging area and having at least three layers. The at least three layers of the central section further including an upper layer constructed of a non-permeable material and having an upper surface, a lower layer constructed of a non-permeable material and having a ground engaging lower surface, and at least one intermediate layer constructed of an insulation material and being located between the upper layer and lower layer. At least one side wall extends upward from and is connected to the central section at an edge of the ground engaging area and further includes at least one layer constructed of a non-permeable material, wherein the at least one side wall has an inward facing surface and an outward facing surface, and an outward facing side wall fastener located on the outward facing surface of the at least one side wall. The central section further includes at least one opening defined by an area where the upper layer is sealed to the lower layer, and a central section fastener is connected to the upper surface of the upper layer of the central section and is located proximate the at least one opening. At least one patch has an upper surface and a lower surface, and a patch fastener connected to the lower surface of the patch and being releasably connected to the central section fastener located proximate the at least one opening.

It is to be understood that both the foregoing general description and the following detailed description are exemplary and provided for purposes of explanation only, and are not restrictive of the subject matter claimed. Further features and objects of the present disclosure will become more fully apparent in the following description of the preferred embodiments and from the appended claims.

BRIEF DESCRIPTION OF THE DRAWINGS

In describing the preferred embodiments, reference is made to the accompanying drawing figures wherein like parts have like reference numerals, and wherein.

It should be understood that the drawings are not to scale. While some mechanical details of example floors and shelters, including other plan and section views of the examples shown and of examples that may have alternative configurations, have not been included, such details are considered well within the comprehension of those of skill in the art in light of the present disclosure. It also should be understood that the present invention is not limited to the example embodiments illustrated.

DETAILED DESCRIPTION OF THE PREFERRED EMBODIMENTS

For the following defined terms, these definitions shall be applied, unless a different definition is given in the claims or elsewhere in this disclosure. As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

Referring generally to FIGS. 1-7, it will be appreciated that removable insulated floors for portable shelters, portable shelter constructions and methods of making an insulated floor and shelter of the present disclosure generally may be embodied within numerous configurations, and may be used in various ways to alter and enhance the comfort and convenience of users. Indeed, while acknowledging that all of the example configurations of shelters need not be shown herein, examples are provided to better demonstrate that a variety of configurations and methods are contemplated.

Figure 2:
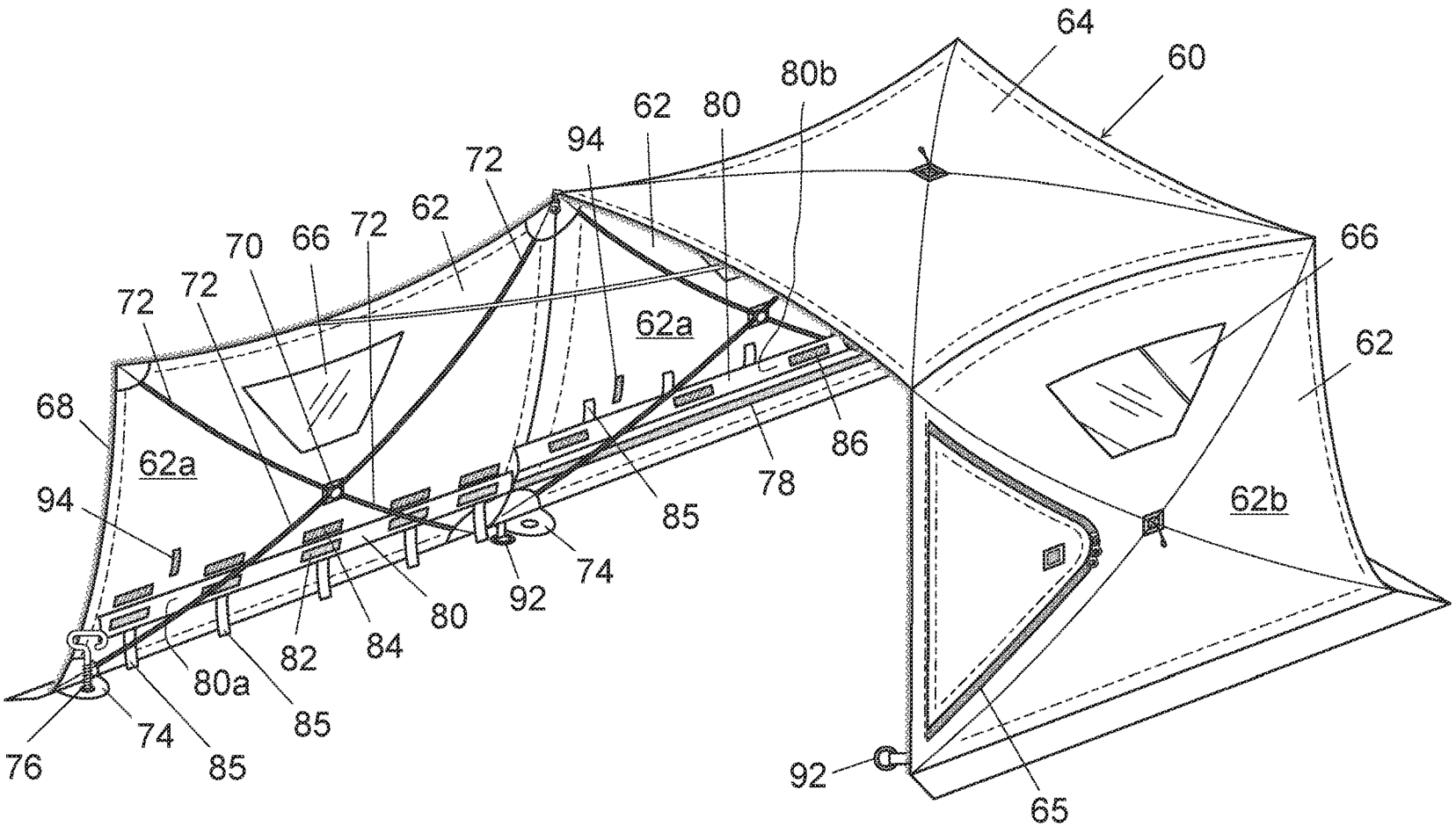
FIG. 2 is a perspective view of the example shelter and floor of FIG. 1, showing a shelter side wall pivoted to an open position, with the removable insulated floor removed, and showing the area and the fasteners on the shelter that are used in initially locating and then more securely connecting the floor to the shelter.
Figure 3:
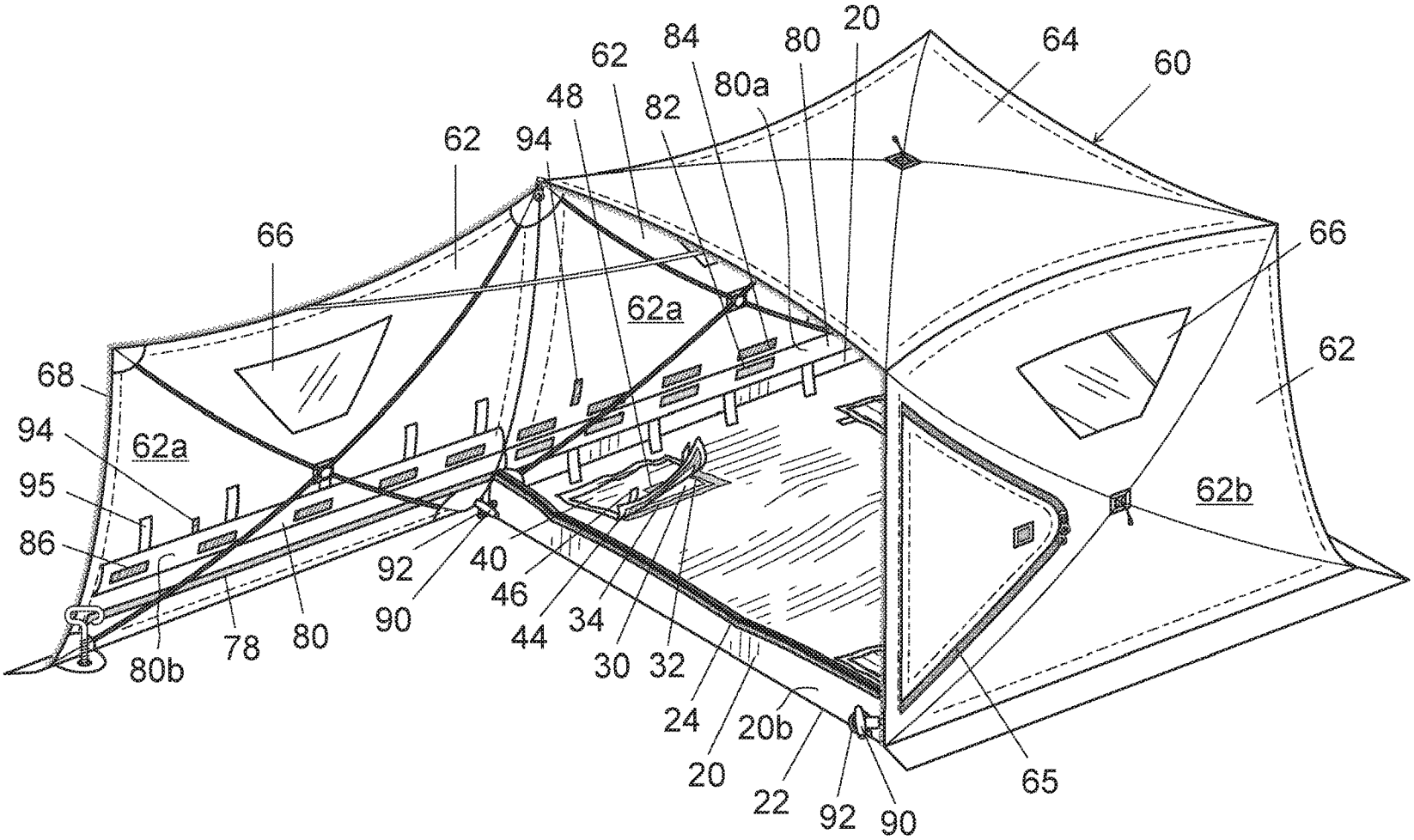
FIG. 3 is a perspective view of the example shelter and floor of FIG. 1, showing a side wall pivoted to an open position, as in FIG. 2, but with the removable insulated floor in position within the shelter and connected to at least one shelter side wall, while the pivoted wall features structures to connect the floor to the shelter and to cover the connection, and showing patches that are attached along one side and that cover openings in the floor.
Figure 4:
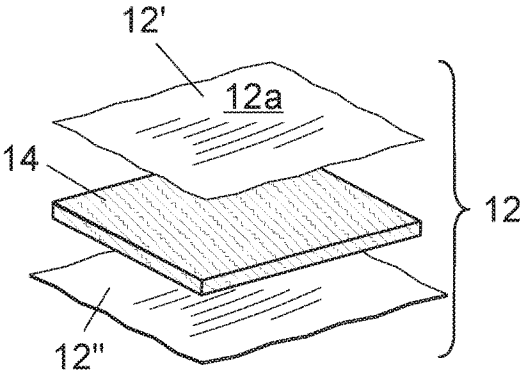
FIG. 4 is a perspective exploded view of an example portion of the central section of the removable insulated floor shown in FIGS. 1 and 3, showing a layered construction.

Turning to FIGS. 1-6, an example embodiment of a removable insulated floor 10 is shown for use with a portable shelter 60. The floor 10 includes a central section 12 defining a ground engaging area, preferably of a polygonal shape, which in this example is a rectangular or square shape. The central section 12 includes at least three layers, with the at least three layers of the central section 12 further including an upper layer 12' constructed of a non-permeable material and having an upper surface 12*a*, a lower layer 12" constructed of a non-permeable material and having a ground engaging lower surface on the underside of the central section 12, and at least one intermediate layer 14 constructed of an insulation material and being located between the upper layer 12' and lower layer 12". A small portion of this structure is represented in FIG. 4.

The non-permeable material of the upper layer 12' generally may be a sheet material that could be referred to as a plastic, vinyl or rubber, and preferably is a single-ply flame retardant polyvinyl chloride (FR PVC) sheet material, although it will be appreciated that other non-permeable materials may be used. The non-permeable material of the lower layer 12" generally may be constructed of a similar material to that of upper layer 12', although different non-permeable materials may be used for the upper and lower layers 12', 12". The at least one intermediate layer 14 is constructed of an insulation material, and preferably is constructed of a single-ply polyethylene (PE) foam sheet material, although it will be appreciated that other insulation materials may be used. It further will be appreciated that there may be more than one layer between the upper layer 12' and lower layer 12", whether of an insulation material or additional non-permeable material.

Figure 6:
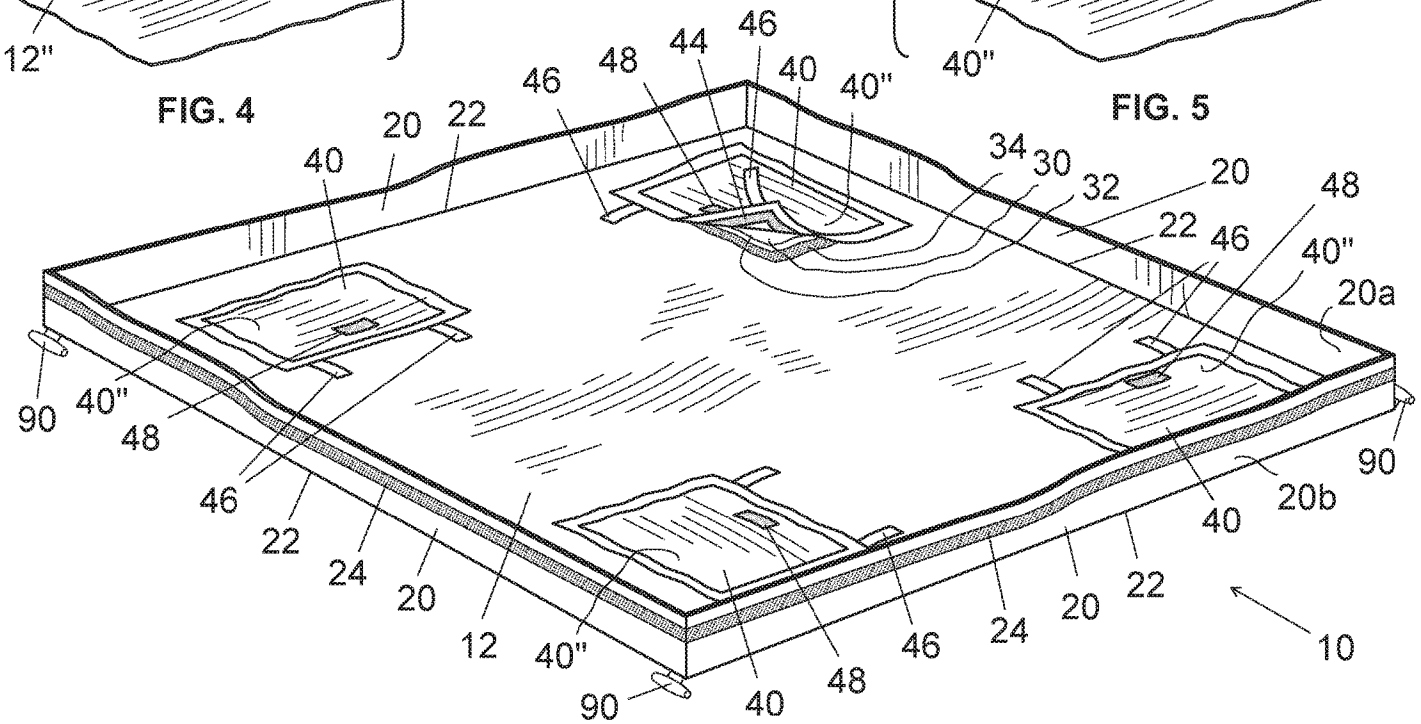
FIG. 6 is a perspective view of the example removable insulated floor shown in FIGS. 1 and 3 and showing openings and patches for the central section of the floor and the initial locating fasteners and side wall fasteners used to secure the floor to the shelter side walls.

The removable insulated floor 10 further includes at least one side wall 20 extending upward from and being connected to the central section 12 at an edge 22 of the ground engaging area and further comprising at least one layer constructed of a non-permeable material, such as is used in the upper layer 12' of the central section 12. The at least one side wall 20 has an inward facing surface 20*a* and an outward facing surface 20*b*, with an outward facing side wall fastener 24 located on the outward facing surface 20*b* of the at least one side wall 20. The outward facing side wall fastener 24 includes a releasable connector of suitable structure and preferably includes one of a hook or loop fastener, or the like. As best seen in FIGS. 3 and 6, it will be understood that the floor 10 may include and preferably includes a plurality of side walls 20 extending upward from and being connected to the central section 12 at edges 22 of the ground engaging area. Each of the plurality of side walls 20 has ends 26, 28 that are connected to ends of respective adjacent side walls. The connection of the ends 26, 28 of the respective adjacent side walls may be permanent, such as by being stitched together, or may be releasable, such as by use of complementary releasable fasteners on the respective ends.

The central section 12 of the floor 10 further includes at least one opening 30 defined by an area 32 where the upper layer 12' is sealed to the lower layer 12", such as around the edge of the opening 30. At the opening 30, the intermediate layer 14 of insulation may be cut back and the edges of the upper layer 12' and lower layer 12" may be sealed together, such as by use of a heat weld, adhesive, or other suitable method of joining the respective components. A central section fastener 34 is connected to the upper surface 12*a* of the upper layer 12' of the central section 12 and is located proximate the at least one opening 30, shown in the first example along three sides of the opening. It will be appreciated that the at least one opening 30 in the central section 12 may include a plurality of openings 30 defined by areas 32 where the upper layer is sealed to the lower layer, such as at the edges of the opening. The central section 12 may further include central section fasteners 34 with each central section fastener 34 connected to the upper surface 12*a* of the upper layer 12' and located proximate one of the respective plurality of openings 30.

Figure 1:
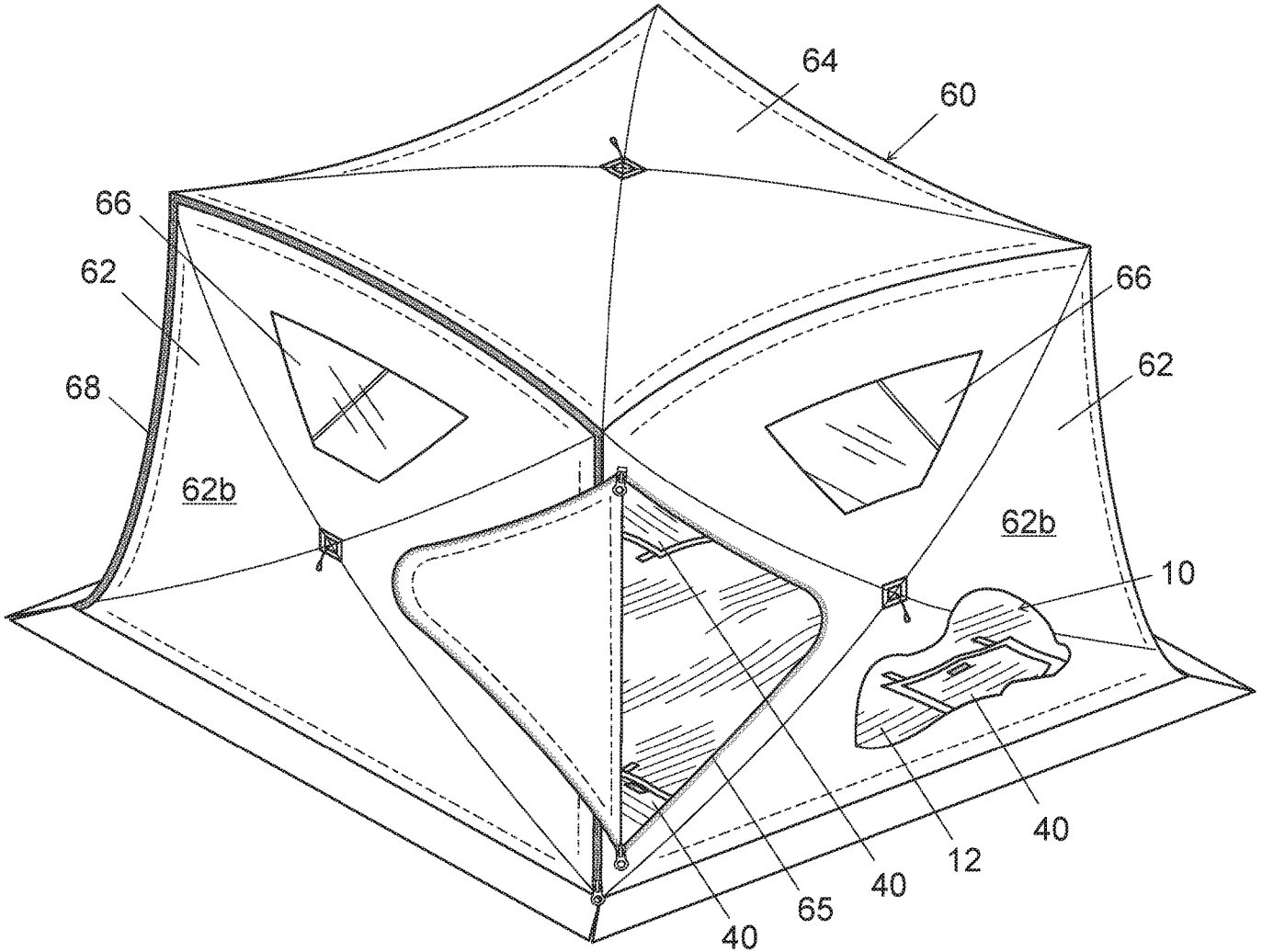
FIG. 1 is a perspective view of an example portable shelter having a removable insulated floor installed, as partially seen through a doorway and a cut away in a shelter side wall.
Figure 5:
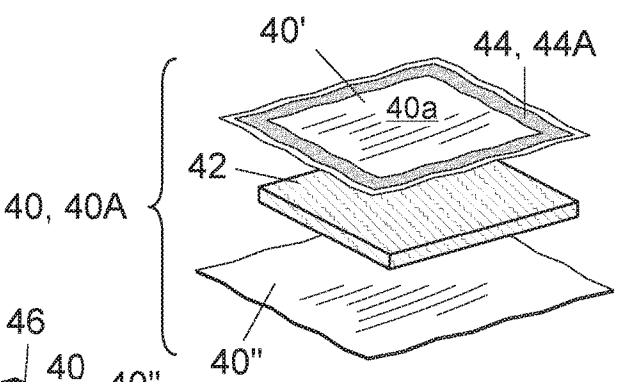
FIG. 5 is a perspective exploded view of an example patch used to cover an opening in the central section of the removable insulated floor shown in FIG. 7 and having a preferred layered construction, although a similar patch construction is used in FIGS. 1, 3 and 6 but with the patch fastener only extending along three edges of the lower surface of the patch.

The central section 12 further includes at least one patch 40. A variation of the example patch 40 is shown upside-down in FIG. 5. The at least one patch 40 includes at least one layer 40' of non-permeable material and having a lower surface 40*a*, which is shown in FIG. 5 at the top of the figure because the patch 40 is shown upside-down. As with the upper and lower layers 12', 12" of the central section 12 of the floor 10, the at least one layer 40' of the patch 40 generally may be a sheet material that could be referred to as a plastic, vinyl or rubber, and preferably is a single-ply flame retardant polyvinyl chloride (FR PVC) sheet material, although it will be appreciated that other non-permeable materials may be used. The at least one patch 40 in FIG. 5 is a variation of what is shown in FIGS. 1, 3 and 6 because a patch fastener 44 is connected to the lower surface 40*a* of the patch 40 along all four edges, which actually corresponds to the patch 40 shown in FIG. 7.

The patch fastener 44 is releasably connected to the central section fastener 34 located proximate the at least one opening 30, shown in the first example in FIGS. 3 and 6 along three edges of the patch 40 that correspond to the three sides of the opening 30 where the central section fastener 34 is located. The example shown in FIGS. 1, 3 and 6 has the fourth edge of the patch 40 permanently connected to the upper layer 12' of the central section 12, such as by use of a heat weld, adhesive, or other suitable method of joining the respective components, along the longer edge that is nearest to the outer edge 22 of the removable insulated floor 10. The central section fastener 34 and patch fastener 44 include complementary releasable connectors of suitable structure and preferably include complementary hook or loop fasteners, or the like, which permits the patch 40 to be connected to the central section 12 along all four edges.

It will be appreciated that as seen in the exploded view of an upside-down patch 40 in FIG. 5, the patch 40 may further include an upper layer 40", preferably constructed of a non-permeable material similar to that of the lower layer 40', and at least one intermediate layer 42 that is constructed of an insulation material, which may be similar to the material of the intermediate layer 14 of the central section 12, although it will be appreciated that other insulation materials may be used. It further will be appreciated that there may be more than one layer between the lower layer 40' and upper layer 40", whether of an insulation material or additional non-permeable material, and that the lower and upper layers 12', 12" are sealed together along the outer edges of the patch 40. The removable insulated floor 10 may include a plurality of patches 40, with each patch 40 having an upper surface and a lower surface 40*a* and having a patch fastener 44 connected to the lower surface 40*a* and being connected to one of the central section fasteners 34 located proximate a respective one of the plurality of openings 30 in the central section 12.

In addition, one or more pull tabs 46 may be provided along at least one side of the patch 40 to facilitate moving the patch 40 to an open position exposing respective opening 30 that is otherwise covered by the patch 40. The pull tabs 46 are most conveniently located along a side of the patch 40 that is opposite the edge that is permanently connected to the central section 12, so as to allow the patch 40 to hinge toward a shelter side wall 62.

This construction, featuring pre-cut openings having overlying patches, avoids having permanently exposed openings that can promote melting of underlying ice and pooling of water. It also avoids the need for a user to cut and reseal edges of an opening in the floor, which could be difficult and/or lead to errors that may cause water intrusion between layers that could result in a reduction of the insulation properties of the floor or difficulty handling a floor that has taken on water. Thus, the precut openings 30 and patches 40 offer optional openings through which to fish, resist melting of the ice below the floor and resists water intrusion both between layers and on top of the layered floor.

It will be appreciated that the at least one side wall 20 may further include at least three layers, similarly to that of the central section 12, as represented in FIG. 4, although the side wall 20 is upward extending, rather than being generally horizontal. Accordingly, the at least one side wall 20 of the floor 10 may include an inner layer 20' constructed of non-permeable material and including the inward facing surface 20*a* of the at least one side wall 20, which may be constructed of a material similar to that described above for the upper layer 12' of the central section 12 of the removable insulated floor 10. The at least one side wall 20 may include an outer layer 20" constructed of non-permeable material and including an outward facing surface 20*b* of the at least one side wall 20. The material of the outer layer 20" may be similar to that of the material of the inner layer 20', or may be a suitable non-permeable alternative material. The at least one side wall 20 also may include an intermediate layer located between the inner layer 20' and outer layer 20" and being constructed of an insulation material, such as was described with respect to the intermediate layer 14 of the example central section 12, and similar to the representation thereof shown in FIG. 4. The at least one side wall 20 has the inner layer 20' sealed to the outer layer 20" at the upper edge of the side wall 20.

The at least one side wall 20 of the floor 10 may be an integral extension from the central section 12. This may be the case whether just the upper layer 12' of the central section 12 extends into the inner layer 20' of an upward extending side wall 20 or the entire at least three layer structure of the central section 12 extends into the side wall 20. Alternatively, the side wall 20 could be separately formed and then joined to the central section 12 proximate its edges 22, such as by use of a heat weld, adhesive or other suitable method of joining the respective components.

As noted, the removable insulated floor 10 may be for use with a portable shelter 60. The portable shelter 60 generally includes a portable enclosure that has a plurality of interconnected shelter side walls 62 defining a floor space and being connected to a top wall 64. Any of the side walls 62 or the top wall 64 may be constructed of a fabric including any suitable material, and preferably they are constructed of a flame resistant insulated fabric, which preferably may include one or more layers to form a flame resistant insulated fabric panel.

Figure 7:
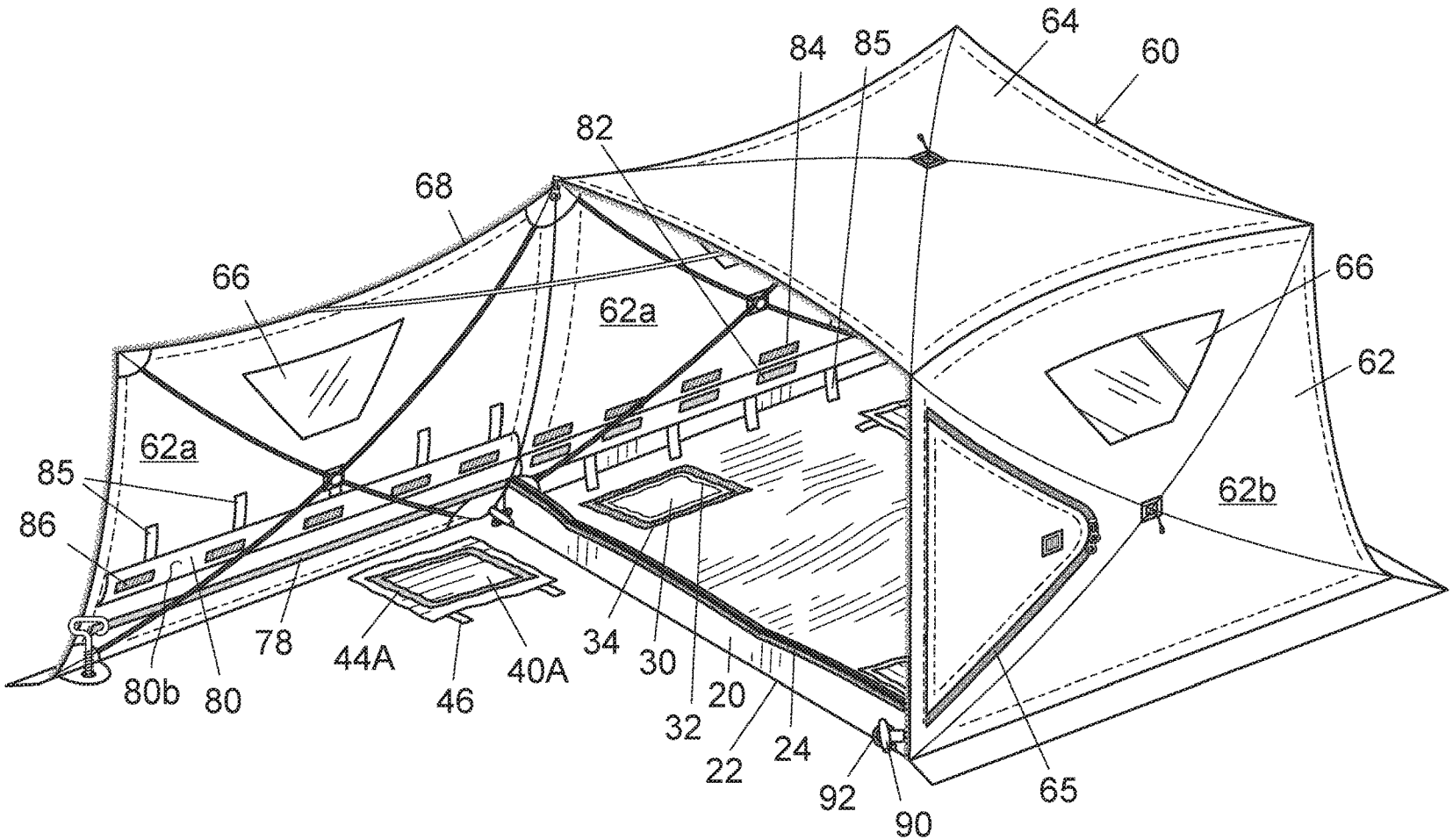
FIG. 7 is a perspective view of an alternative example removable insulated floor in position within a shelter and showing a side wall of the shelter pivoted to an open position, similarly to FIG. 2, but configured to accommodate an alternative removable insulated floor having fully removable patches for the openings in the floor.

For convenience of entry and exit to the defined floor space of the shelter 60, at least one of the shelter side walls 62 may include a doorway 66. FIGS. 1-3 and 7 show an example doorway 66 in a side wall, in the for of a zippered flap, although alternative means of providing an opening in a side wall 62 may be provided. A side wall 62 or the top wall 64 also may include a window 66 constructed of a transparent material or a non-transparent flap that may extend over an opening in a side wall. Also, while the side walls 62 may be permanently connected, as seen in FIGS. 2, 3 and 7, an entire side wall 62 may be connected by one or more fasteners, such as a zipper 68 that allows the side wall 62 to be hinged open or removed.

The shelter 60 further may be a collapsible, portable shelter and at least one of the side walls 62 or the top wall 64 may further include a pop up structure having a hub 70 that is connected to a plurality of rods 72, with the rods 72 being connected to the corners of the side walls 62 and/or top wall 64, so as to place the respective fabric panel in tension and support the at least one side wall 62 and/or top wall 64. The shelter side walls 62 may include internal anchor straps 74, each of which extends from the bottom of a side wall 62 and has an eyelet therethrough that may receive an anchor 76 for holding the side wall to the ground surface, such as the ice.

In FIGS. 2, 3 and 7, as are visible for different respective side walls 62 of the shelter 60, the at least one of the shelter side walls 62 may further include an inward facing surface 62*a* and an outward facing surface 62*b*, and may include a first shelter side wall fastener 78 located on the inward facing surface 62*a* of the side wall 62. The first shelter side wall fastener 78 preferably is elongated to provide a good holding area and secure connection, which may be constructed of a hook or loop fastener material, or other suitable fasteners. The first shelter side wall fastener 78 also is releasably connected to the at least one outward facing side wall fastener 24 located on the outward facing surface 20*b* of the at least one side wall 20 of the removable insulated floor 10. It will be appreciated that the shelter 60 may include a plurality of side walls 62, and each side wall 62 may include an inward facing surface and an outward facing surface, with a first shelter side wall fastener 78 located on the inward facing surface. For a secure connection of the floor 10 to a shelter 60, the floor 10 may correspondingly include a plurality of side walls 20, with each side wall 20 extending upward from and being connected to the central section 12 at an edge 22 of the ground engaging area and having an outward facing side wall fastener 24 located on the outward facing surface 20*b* of the respective side wall 20, and with a respective first shelter side wall fastener 78 on the inward facing surface 62*a* of each shelter side wall 62 releasably connected to the respective outward facing side wall fastener 24 located on the outward facing surface 20*b* of one of the side walls 20 of the floor 10.

To assist in preventing items from becoming inadvertently attached to the first shelter side wall fastener 78 on a side wall 62 of the shelter 60, it is helpful to be able to cover the first shelter side wall fastener 78 when it is not connected to an installed floor 10. As such, at least one of the shelter side walls 62 may further include a flap 80 connected to the at least one shelter side wall 62 at a location above the at least one side wall 20 of the floor 10. The flap 80 may include an upward facing surface 80*a* and a downward facing surface 80*b*, wherein the flap 80 has at least one flap fastener 82 located on the upward facing surface 80*a*, and wherein the at least one flap fastener 82 is connected to a second shelter side wall fastener 84 located on the inward facing surface 62*a* of the at least one shelter side wall 62 at a location above where the flap 80 is connected to the at least one shelter side wall 62 when the flap 80 is folded upward.

The flap 80 further may include at least a second flap fastener 86 located on the downward facing surface 80*b*, wherein the at least one second flap fastener 86 is connected to a respective first shelter side wall fastener 78 on a side wall 62 of the shelter 60 when the floor 10 is not installed in the shelter 60 and the flap 80 is folded downward. When the floor 10 is installed in the space defined by the shelter walls 62, the at least one flap 80 may be folded downward simply to cover over the top of the respective upwardly extending side wall 20 that would have a fastener 24 connected to the first shelter side wall fastener 78. It will be appreciated that a plurality of such flaps 80 and associated flap fasteners 82, 86 may be used for convenience to protect first shelter side wall fasteners 78, or to hold the flap 80 upward against a second shelter side wall fastener 84. Also, each flap 80 may include at least one pull tab 85 to facilitate moving the respective flap to an upward or downward folded position.

It can be difficult to maneuver a large portable floor and align fasteners, so to help facilitate this, the floor 10 may further include at least one initial locating fastener 90 extending outward relative to the at least one side wall 20 of the floor 10. An example initial locating fastener 90 is shown as including what may be referred to as a T-shaped fastener, which includes a rod that is connected to the floor 10 by a fabric tab. The shelter 60 may include a respective at least one initial locating fastener 92 proximate a lower end of at least one shelter side wall 62 and extending inward. The at least one initial locating fastener 92 on the shelter 60 may be referred to as a ring-shaped fastener, which includes a ring that is connected to the shelter 60 by a fabric tab.

It will be appreciated that the initial locating fastener 90 extending outward from the floor 10 is releasably connected to the initial locating fastener 92 extending inward from the shelter 60, such as when the rod of the T-shaped initial locating fastener 90 extending from the floor is passed through the ring of the ring shaped initial fastener 92 extending from the shelter 60. It will be appreciated that in a preferred example, a removable insulated floor 10 may have a plurality of side walls 20 extending upward from and being connected to the central section 12 at edges 22 of the ground engaging area and a plurality of initial locating fasteners 90 spaced around the central section 12 and extending outward relative to the plurality of side walls 20 of the floor 10. A shelter 60 then may include a plurality of initial locating fasteners 92 spaced around the shelter 60 proximate a lower end of the shelter side walls 62 and extending inward. This would permit the initial locating fasteners 90 extending outward relative to the side walls 20 of the floor 10 to be releasably connected to the initial locating fasteners 92 extending inward from the shelter 60. Thus, a user may essentially initially lay out the floor 10 and initially connect the floor 10 to the shelter 60 at a plurality of locations, typically at the corners of the floor 10. Thereafter, it should be more convenient for the user to connect the fasteners 24 on the respective outward facing surfaces 20*b* of the side walls 20 of the floor to the respective first shelter side wall fasteners 78 on the inward facing surface of the side walls 62 of the shelter 60. This use of first and second stage fasteners facilitates more convenient floor installation, while ultimately providing for a secure connection of the floor 10 to the shelter 60. As a result, the removable insulated floor 10 can be relatively compact, lightweight, easy to fold or roll for stowing or carrying, and easy to layout and securely install within a shelter 60 in a manner that will result in the floor 10 having a tendency to stay in place.

Also, to assist in holding a patch 40 in an open position, a fastener 48 may be connected to the upward facing surface of the upper layer 40" of the at least one patch 40, which may be releasably connected to a holding fastener 94 that may be connected to an inward facing surface 62*a* of at least one of the shelter side walls 62, at a location above where the flap 80 is connected to the at least one shelter side wall 62. Thus, the patch 40 may be opened, such as by pulling on the pull tabs 46 and hinging the patch 40 toward the side wall 62 nearest to its affixed long edge, and then the fastener 48 on the upper layer 40" may be connected to the holding fastener 94 on the side wall 62 to hold the patch 40 when it has been moved to the open position, exposing the at least one opening 30 in the central section 12 of the removable insulated floor 10.

FIGS. 5 and 7 help to show an alternative patch 40A that may be constructed of similar materials to those for patch 40, but wherein patch 40A is not permanently connected to the central section 12 of the floor 10 along one edge. Rather, patch 40A has a fastener 44A extending proximate all of its outer edges, while the central section fastener 34 is connected proximate all of the edges of an opening 30 in the central section 12 of the floor 10. Thus, the alternative patch 40A may include a single layer, as was described with respect to patch 40, and may otherwise be constructed in a similar way to that of patch 40, including at least a lower layer 40', at least an upper layer 40" and at least one intermediate layer 42 that preferably is constructed of an insulation material consistent with that previously described. The alternative patches 40A can conveniently be fully removed and stowed when there is a need to expose an opening 30 in the central section 12 of the floor 10.

From the above disclosure, it will be apparent that removable insulated floors for portable shelters, constructed in accordance with this disclosure may include a number of structural aspects that provide numerous advantages. The example aspects of removable insulated floors and portable shelter constructions shown herein may exhibit one or more of the above-referenced potential advantages, depending upon the specific design chosen.

It will be appreciated that a removable insulated floor for portable shelters constructed in accordance with the present disclosure may be provided in various configurations. Any variety of suitable materials of construction, configurations, shapes and sizes for the components and methods of connecting the components of the floors and/or shelters may be utilized to meet the particular needs and requirements of an end user. It is to be understood that the invention is not to be limited to the disclosed example embodiments, but rather, is intended to cover various modifications and equivalent arrangements included within the spirit and scope of the appended claims. Thus, the description and drawings should be considered illustrative and not restrictive of the invention, which is limited only by the appended claims and their legal equivalents.

The invention claimed is:

1. A removable insulated floor in combination with a portable shelter having a plurality of interconnected shelter side walls defining a floor space and being connected to a top wall, comprising:

the floor including a central section defining a ground engaging area and comprising at least three layers;

the at least three layers of the central section further comprising an upper layer constructed of a non-permeable material and having an upper surface, a lower layer constructed of a non-permeable material and having a ground engaging lower surface, and at least one intermediate layer constructed of an insulation material and being located between the upper layer and lower layer;

at least one side wall extending upward from and being connected to the central section at an edge of the ground engaging area and further comprising at least one layer constructed of a non-permeable material, wherein the at least one side wall has an inward facing surface and an outward facing surface;

an outward facing side wall fastener located on the outward facing surface of the at least one side wall;

the central section further comprising at least one opening defined by an area where the upper layer is sealed to the lower layer, and a central section fastener is connected to the upper surface of the upper layer of the central section and is located proximate the at least one opening;

at least one patch having an upper surface and a lower surface, and having a patch fastener connected to the lower surface of the patch and being releasably connected to the central section fastener located proximate the at least one opening; and wherein the plurality of shelter side walls each comprises an inward facing surface and an outer facing surface, and the outward facing side wall fastener located on the outward facing surface of the at least one side wall of the floor being releasably connected to a first shelter side wall fastener located on the inward facing surface of at least one of the shelter side wall; and wherein the at least one patch further comprises a fastener on the upward facing surface of the patch that is releasably connected to a holding fastener that is connected to the inward facing surface of at least one of the shelter side walls when the patch is moved to a position exposing the at least one opening in the central section of the floor.

2. The floor in combination with the shelter in accordance with claim 1, wherein the outward facing side wall fastener further comprises a hook or loop fastener.

3. The floor in combination with the shelter in accordance with claim 1, wherein the at least one side wall further comprises at least three layers including an inner layer constructed of non-permeable material and including the inward facing surface of the at least one side wall, an outer layer constructed of non-permeable material and including the outward facing surface of the at least one side wall, and an intermediate layer located between the inner layer and outer layer and being constructed of an insulation material.

4. The floor in combination with the shelter in accordance with claim 1, wherein the at least one side wall is an integral extension from the central section.

5. The floor in combination with the shelter in accordance with claim 1, wherein the ground engaging area defined by the central section further comprises a polygonal shape.

6. The floor in combination with the shelter in accordance with claim 1, wherein the central section fastener connected to the upper surface of the upper layer and located proximate the at least one opening in the central section further comprises a hook or loop fastener.

7. The floor in combination with the shelter in accordance with claim 1, wherein the patch fastener connected to the lower surface of the at least one patch further comprises a hook or loop fastener.

8. The floor in combination with the shelter in accordance with claim 1, wherein the at least one patch further comprises at least three layers including an upper layer constructed of non-permeable material and having an upper surface, a lower layer constructed of non-permeable material and having a lower surface, and an intermediate layer constructed of an insulation material and being located between the upper layer and lower layer.

9. The floor in combination with the shelter in accordance with claim 1, wherein the at least one side wall further comprises a plurality of side walls extending upward from and being connected to the central section at edges of the ground engaging area.

10. The floor in combination with the shelter in accordance with claim 9, wherein each of the plurality of side walls has ends that are connected to ends of respective adjacent side walls.

11. The floor in combination with the shelter in accordance with claim 1, wherein the at least one opening in the central section further comprises a plurality of openings defined by areas where the upper layer is sealed to the lower layer, and having central section fasteners with each central section fastener connected to the upper surface of the upper layer and located proximate one of the respective plurality of openings.

12. The floor in combination with the shelter in accordance with claim 11, wherein the at least one patch further comprises a plurality of patches, with each patch having an upper surface and a lower surface and having a patch fastener connected to the lower surface and being connected to one of the central section fasteners located proximate a respective one of the plurality of openings in the central section.

13. The floor in combination with the shelter in accordance with claim 1, wherein at least one of the shelter side walls further comprises a doorway.

14. The floor in combination with the shelter in accordance with claim 1, wherein the at least one of the shelter side walls comprises each of the shelter side walls including a first shelter side wall fastener located on the inward facing surface, wherein the at least one side wall of the floor further comprises a plurality of side walls with each extending upward from and being connected to the central section at an edge of the ground engaging area and having an outward facing side wall fastener located on the outward facing surface of the respective side wall, and with the first shelter side wall fastener on the inward facing surface of each shelter side wall releasably connected to the respective outward facing side wall fastener located on the outward facing surface of one of the side walls of the floor.

15. The floor in combination with the shelter in accordance with claim 1, wherein the at least one of the shelter side walls further comprises a flap connected to the at least one shelter side wall at a location above the at least one side wall of the floor, with the flap having an upward facing surface and a downward facing surface, wherein the flap has at least one flap fastener located on the upward facing surface, and wherein the at least one flap fastener is connected to a second shelter side wall fastener located on the inward facing surface of the at least one shelter side wall at a location above where the flap is connected to the at least one shelter side wall when the flap is folded upward.

16. The floor in combination with the shelter in accordance with claim 1, wherein the floor further comprises at least one initial locating fastener extending outward relative to the at least one side wall of the floor, wherein the shelter further comprises at least one initial locating fastener proximate a lower end of at least one shelter side wall and extending inward, and the initial locating fastener extending outward from the floor is releasably connected to the initial locating fastener extending inward from the shelter.

17. The floor in combination with the shelter in accordance with claim 16, wherein the at least one side wall of the floor further comprises a plurality of side walls extending upward from and being connected to the central section at edges of the ground engaging area and the at least one initial locating fastener of the floor further comprises a plurality of initial locating fasteners spaced around the central section and extending outward relative to the plurality of side walls of the floor, wherein the shelter further comprises the at least one initial locating fastener comprising a plurality of initial locating fasteners spaced around the shelter proximate a lower end of the shelter side walls and extending inward, and the initial locating fasteners extending outward relative to the side walls of the floor are releasably connected to the initial locating fasteners extending inward from the shelter.

18. The floor in combination with the shelter in accordance with claim 1, wherein the shelter is collapsible and at least one of the side walls or the top wall further comprises a pop up structure having a hub that is connected to a plurality of rods, with the rods supporting the at least one side wall or top wall.

19. The removable insulated floor in combination with the shelter in accordance with claim 1, wherein at least one of the plurality of shelter side walls of the portable shelter further comprises a hinged side wall that is pivotally connected to another of the plurality of side walls and the hinged side wall includes opposed first and second side perimeter edges and a top perimeter edge that define an opening in the portable shelter; and at least one connecting member on the portable shelter being configured to selectively connect and disconnect at least the first side perimeter edge and the top perimeter edge of the hinged side wall at the opening, wherein the hinged side wall is pivotable about a generally vertical axis to an open position that provides access to the floor space.

20. The floor in combination with the portable shelter in accordance with claim 19, wherein the outward facing side wall fastener further comprises a hook or loop fastener.

* * * * *